US007806145B1

(12) United States Patent
Clark

(10) Patent No.: US 7,806,145 B1
(45) Date of Patent: Oct. 5, 2010

(54) HOUSING FOR A FLOW CONDITIONER

(76) Inventor: Derold Gary Clark, 48 Jarvis Bay Drive, Sylvan Lake, AB (CA) T4S 1R9

( * ) Notice: Subject to any disclaimer, the term of this patent is extended or adjusted under 35 U.S.C. 154(b) by 0 days.

(21) Appl. No.: 12/604,778

(22) Filed: Oct. 23, 2009

(51) Int. Cl.
*F15D 1/02* (2006.01)

(52) U.S. Cl. ..... 138/44; 138/94; 138/94.3; 251/182; 73/861.61

(58) Field of Classification Search ..... 138/44, 138/45, 94, 94.3, 37; 251/182, 193, 210, 251/206
See application file for complete search history.

(56) References Cited

U.S. PATENT DOCUMENTS

| | | | | |
|---|---|---|---|---|
| 1,996,192 A | | 4/1935 | Daniel | 251/176 |
| 4,168,725 A | | 9/1979 | Astakhov et al. | 138/44 |
| 4,425,806 A | | 1/1984 | Van Scoy | 73/861.61 |
| 4,478,251 A | * | 10/1984 | Sanchez et al. | 138/44 |
| 4,503,594 A | * | 3/1985 | Gall et al. | 29/890.142 |
| 4,592,390 A | * | 6/1986 | Boyd | 138/45 |
| 5,042,531 A | * | 8/1991 | Foster et al. | 138/44 |
| 5,327,938 A | | 7/1994 | Crane | 138/44 |
| 5,456,288 A | | 10/1995 | Jacobs | 138/44 |
| 5,495,872 A | | 3/1996 | Gallagher et al. | 138/44 |
| 5,617,899 A | | 4/1997 | Linton et al. | 138/44 |
| 5,836,356 A | * | 11/1998 | Desai | 138/44 |
| 6,647,806 B1 | | 11/2003 | Estrada et al. | 73/861.28 |
| 6,651,514 B2 | | 11/2003 | Zanker | 73/861.52 |
| 7,235,121 B2 | | 6/2007 | West | 95/273 |

* cited by examiner

*Primary Examiner*—Patrick F Brinson
(74) *Attorney, Agent, or Firm*—Davis & Bujold, P.L.L.C.

(57) ABSTRACT

There is provided a housing for a flow conditioner. The housing comprises a body having first and second pipe connections, a flow passage between the pipe connections, a carrier receiving cavity within the flow passage, and an opening corresponding to the carrier receiving cavity. A plate carrier has a sealing portion and a flow conditioner carrying portion. The sealing portion has a sealing surface for sealing the opening corresponding to the carrier receiving cavity, and the flow conditioner carrying portion depends from the sealing portion. The flow conditioner carrying portion is sized to be inserted through the opening and into the carrier receiving cavity, and has a plurality of set screw receiving apertures or a retaining lip for securing the flow conditioner. There is a connector for securing the plate carrier within the body such that the sealing surface seals against the body.

1 Claim, 6 Drawing Sheets

HOUSING FOR A FLOW CONDITIONER

FIELD

This relates to a housing for a flow conditioner.

BACKGROUND

The two common methods of mounting a flow conditioner in a pipeline include inserting set screws through the pipeline to engage the flow conditioner, or to provide a conditioner with a flange that is held between two abutting pipeline segments.

SUMMARY

There is provided a housing for a flow conditioner. The flow conditioner comprises a circular plate having an outer perimeter and flow conditioning apertures. The housing comprises a body having a first pipe connection, a second pipe connection, a flow passage between the first and second pipe connections, a carrier receiving cavity within the flow passage, and an opening corresponding to the carrier receiving cavity. The carrier receiving cavity has a larger diameter than the flow passage. A plate carrier has a sealing portion and a flow conditioner carrying portion. The sealing portion has a sealing surface for sealing the opening corresponding to the carrier receiving cavity, and the flow conditioner carrying portion depends from the sealing portion. The flow conditioner carrying portion is sized to be inserted through the opening and into the carrier receiving cavity. The flow conditioner carrying portion has an inner surface for carrying the flow conditioner and an outer surface, the inner surface being substantially the same size as the flow passage. The flow conditioner carrying portion has a plurality of set screw receiving apertures extending from the outer surface to the inner surface for adjusting the position of the flow conditioner within the inner surface. There is a connector for securing the plate carrier within the body such that the sealing surface seals against the body.

Alternatively, instead of set screw apertures, the flow conditioner carrying portion may have a retaining lip extending inward from the inner surface for securing the flow conditioner on a downstream side against pressure from an upstream side, the inner surface being sized to friction fit the flow conditioner.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
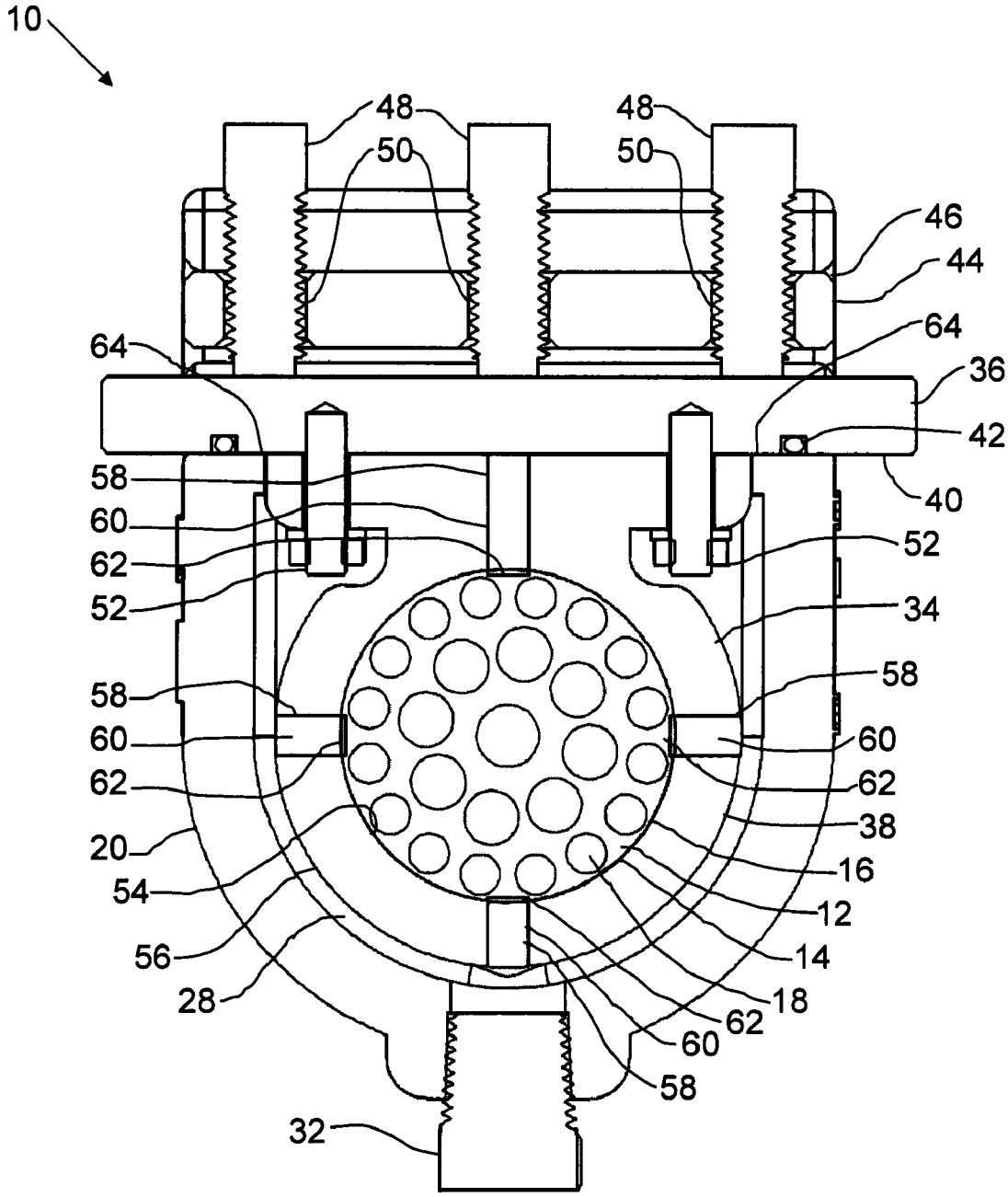
FIG. 1 is a side view in section of a housing for a flow conditioner with a conditioner installed.

A housing for a flow conditioner generally identified by reference numeral 10 will now be described with reference to FIGS. 1 through 8.

Figure 2:
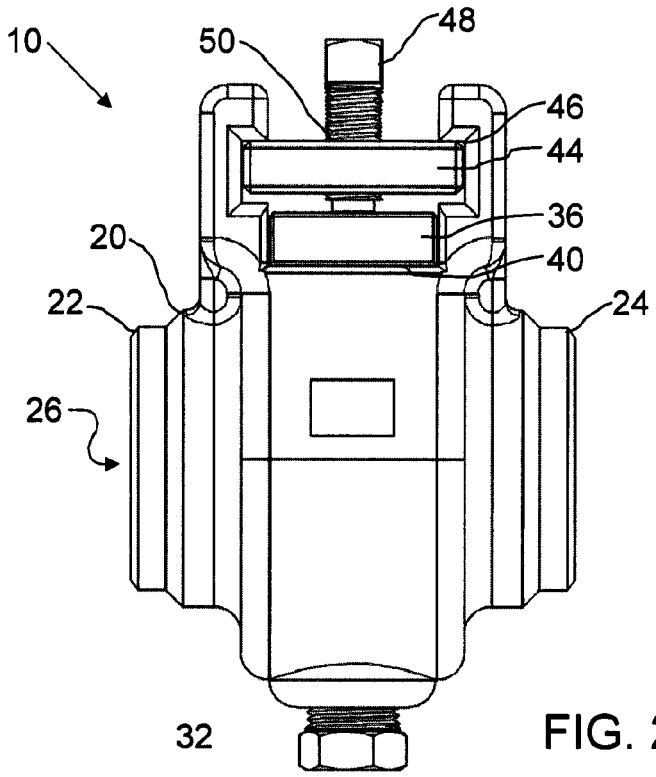
FIG. 2 is a side elevation view of the housing for a flow conditioner.

Structure and Relationship of Parts:

Referring to FIG. 1, housing 10 for flow conditioner 12 is shown. Flow conditioner 12 has a circular plate 14 having an outer perimeter 16 and flow conditioning apertures 18. Referring to FIG. 2, a body 20 of housing 10 has a first pipe connection 22, a second pipe connection 24 and a flow passage 26 between first and second pipe connections 22 and 24. As depicted, first and second pipe connections 22 and 24 are designed to be attached to pipe sections by welding. However, it will be understood that connections 22 and 24 could also be designed for other types of connections, such as threaded, flanged, etc. as is known in the industry. There is a carrier receiving cavity 28 within flow passage 26, and an opening 30 corresponding to carrier receiving cavity 28. As can be seen, carrier receiving cavity 28 has a larger diameter than flow passage 26. A pipe plug 32 is located at the bottom of carrier receiving cavity 28 to allow for cleanout, and to assist in installing and removing flow conditioner 12.

Figure 5:
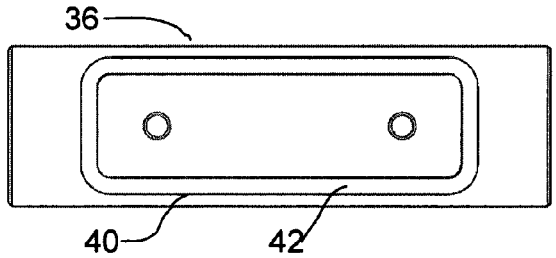
FIG. 5 is a bottom plan view of the sealing portion of the plate carrier.
Figure 6:
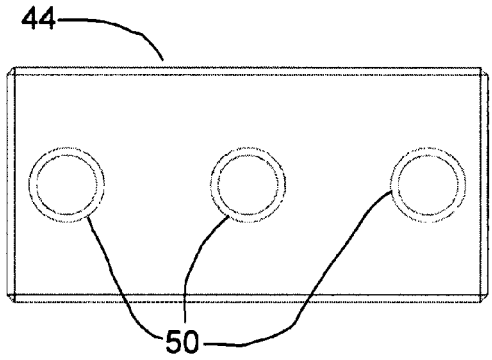
FIG. 6 is a top plan view of the clamp bar.
Figure 7:
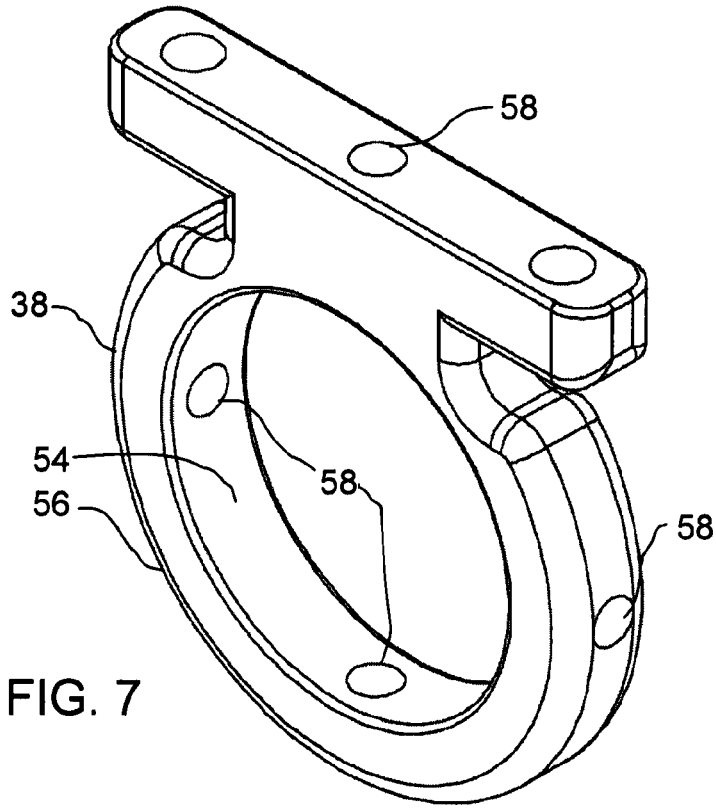
FIG. 7 is a perspective view of the flow conditioner carrying portion of the plate carrier.

Referring to FIG. 1, a plate carrier 34 is used to hold flow conditioner 12. Plate carrier 34 has a sealing portion 36 and a flow conditioner carrying portion 38. Referring to FIG. 5, sealing portion 36 has a sealing surface 40, which includes a seal 42, for sealing opening 30 that corresponding to carrier receiving cavity 28. Opening 30 can be seen in FIG. 4. Referring to FIG. 2, sealing portion 36 is secured in place over opening 30 by using connector, in this case, a clamp bar 44. Clamp bar 44 is inserted into a slot 46 in body 20, and threaded pins 48 are inserted through holes 50 to apply downward pressure on sealing portion 36 to secure plate carrier 34 within body 12 such that sealing surface 40 seals against body 20. A top view of clamp bar 44 is shown in FIG. 7.

Figure 3:
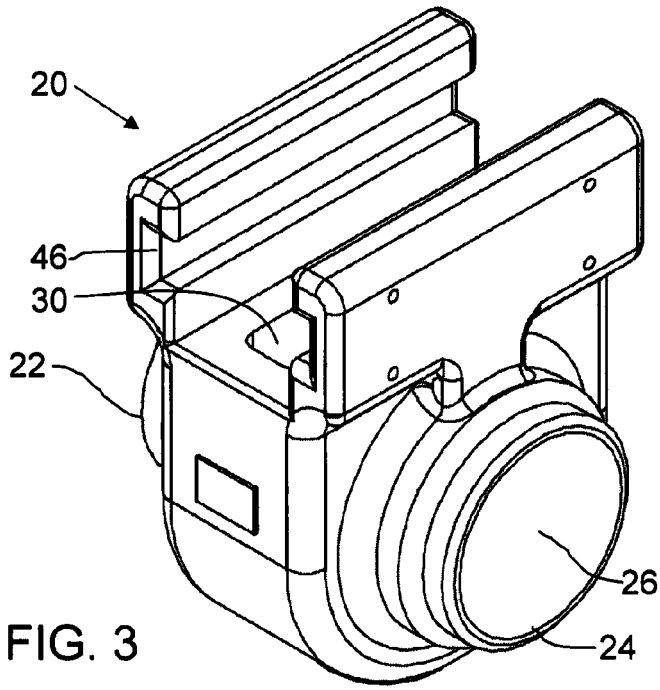
FIG. 3 is a perspective view of the body of the housing.
Figure 4:
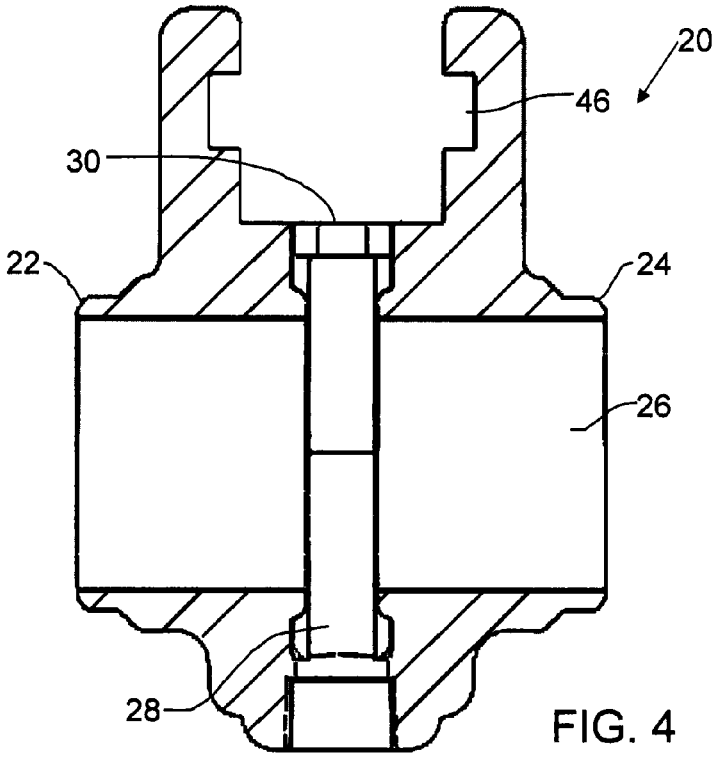
FIG. 4 is a side elevation view in section of the body of the housing.
Figure 8:
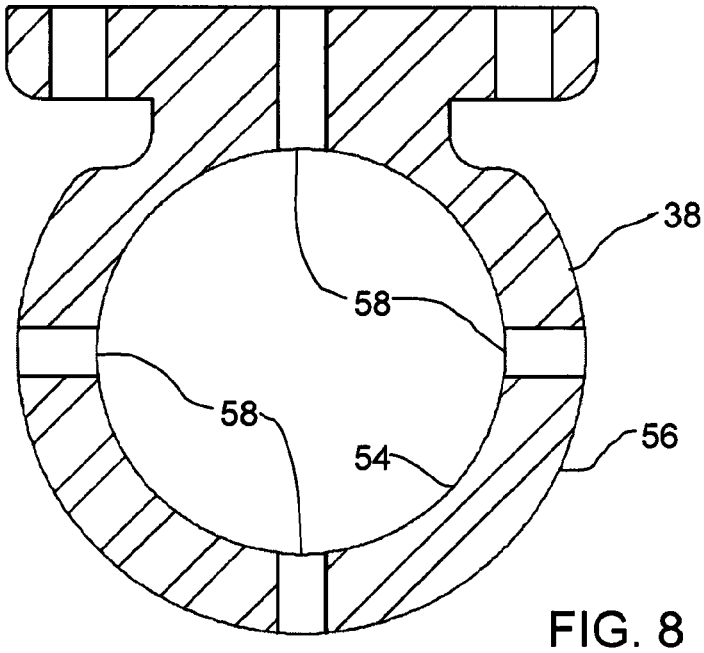
FIG. 8 is a side elevation view in section of the flow conditioner carrying portion of the plate carrier.

Referring to FIG. 1, flow conditioner carrying portion 38 depends from sealing portion 36. In the depicted embodiment, sealing portion 36 and flow conditioner carrying portion 38 are attached by screws 52. These portions may be otherwise connected together, or integrally formed. As will be seen below, a removable connection allows easier access to set screws 60, which are used to position flow conditioner 60. Referring to FIGS. 1 and 3, flow conditioner carrying portion 38 is sized to be inserted through opening 30 and into carrier receiving cavity 28. Referring to FIGS. 7 and 8, flow conditioner carrying portion 38 has an inner surface 54 for carrying flow conditioner 12 (as shown in FIG. 1) and an outer surface 56. Inner surface 54 is designed to be substantially the same size as flow passage 26 shown in FIG. 4. Flow conditioner carrying portion 38 has a plurality of set screw receiving apertures 58 extending from outer surface 56 to inner surface 54. Referring to FIG. 1, this allows set screws 60 to be inserted that can then be used to secure the position of flow conditioner 12 within inner surface 54, and also center flow conditioner 12 relative to flow passage 26. Preferably, there are four set screw apertures 58 and screws 60, which allows the position to be easily adjusted vertically and horizontally, although this may also be accomplished using three apertures 58 and screws 60. Flow conditioner 12 preferably has small recesses 62 that correspond to set screws 60 that allow flow conditioner 12 to be gripped by screws 60 against fluid pressure along flow passage 26. Body 20 has machined tabs 64 in opening 30 that maintain the horizontal position of flow conditioner 12 by holding the top of flow conditioner carrying portion 38.

Operation:

Referring to FIG. 3, body 20 is installed in a pipeline, generally upstream of a flow meter, by connecting first and second pipe connections 22 and 24 in a pipeline. As shown, connections 22 and 24 are designed to be welded, but may be designed with threaded or flanged connections. Once welded at connections 22 and 24, the only possibility for leakage is through opening 38, as body 20 is otherwise solid and closed. Referring to FIG. 1, plate carrier 34 is assembled by inserting flow conditioner 12 within flow conditioner carrying portion 38 and secured and centered by set screws 60. Flow conditioner carrying portion 38 is then attached to sealing portion 36. Once assembled, plate carrier 34 is inserted through opening 30 into cavity 28. Clamp bar 44 is slid into slot 46, and threaded pins 48 are inserted to apply pressure to sealing portion 36 such that opening 30 is sealed and plate carrier 34 is secured in place. As depicted, vertical position is maintained by the contact between the sealing surface 40 of sealing portion 36 and opening 30 of body 20. The horizontal position is maintained by the contact of the machined tabs 64 in opening 30 against the top of flow conditioner carrying portion 38.

Plate carrier 34 is removed for servicing or inspection by removing clamp bar 44. The depicted design allows a user to reposition flow conditioner carrying portion 38 each time it is removed, such that, once properly set, flow conditioner 12 will remain in the same position despite plate carrier 34 being removed and replaced.

Figure 9:
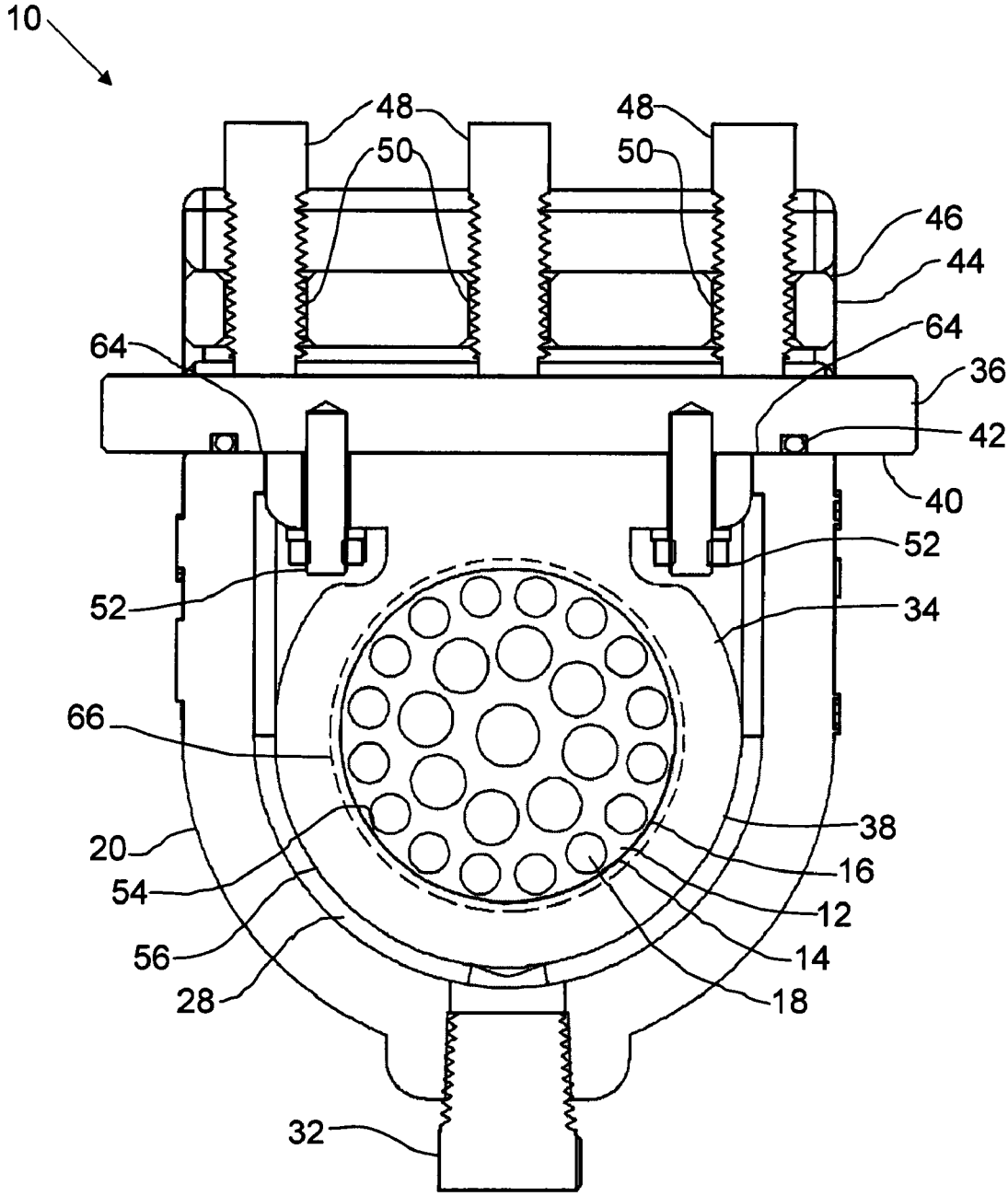
FIG. 9 is a side view in section of a housing for a flow conditioner with the flow conditioner held in a friction fit arrangement.

Variations:

As an alternative to set screws 60, referring to FIG. 9, flow conditioner carrying portion 38 may be designed to have a closer fit, such that flow conditioner 12 is held in a friction fit arrangement. In addition, a flange 66 may be provided on the downstream side to prevent flow conditioner 12 from becoming dislodged due to fluid pressure.

Figure 10:
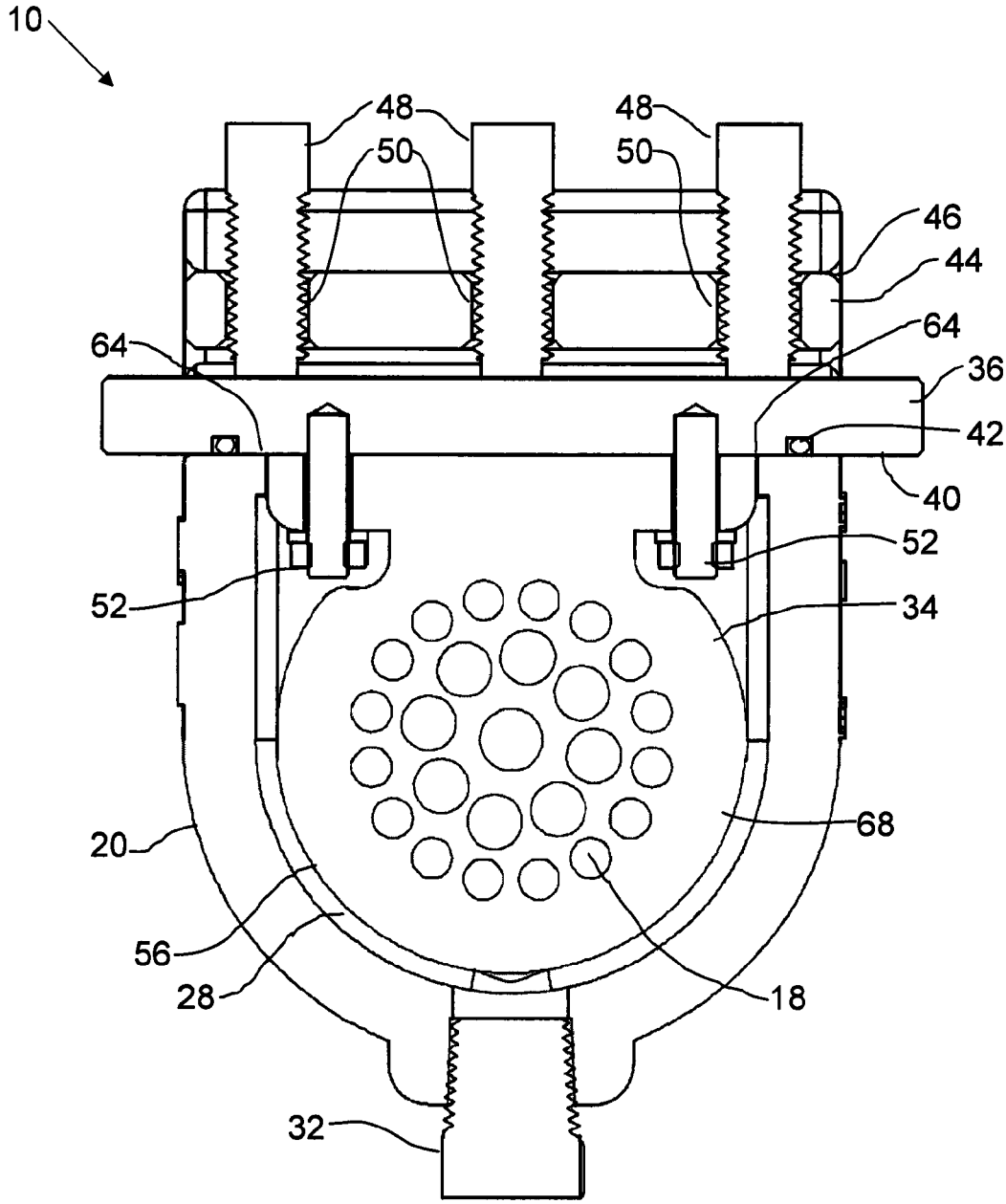
FIG. 10 is a side view in section of a housing for a flow conditioner with the flow conditioner integrally formed with the carrier plate.

Referring to FIG. 10, a further alternative may have flow conditioner 12 integrally formed with plate carrier 34. In this embodiment, flow conditioner carrier portion 38 is replaced with flow conditioner portion 68, with flow conditioning apertures 18 positioned within portion 68 to properly align within flow passage 26 (shown in FIG. 4).

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A housing for a flow conditioner, comprising:

a body having a first pipe connection, a second pipe connection, a flow passage between the first and second pipe connections, a carrier receiving cavity within the flow passage, and an opening corresponding to the carrier receiving cavity, the carrier receiving cavity having a larger diameter than the flow passage;

a plate carrier having a sealing portion and a flow conditioner portion, the sealing portion having a sealing surface for sealing the opening corresponding to the carrier receiving cavity, the flow conditioner portion depending from the sealing portion, wherein:

the flow conditioner portion is sized to be inserted through the opening and into the carrier receiving cavity; and the flow conditioner portion comprises a plurality of flow conditioning apertures positioned within the flow conditioner portion such that, when the plate carrier is installed, the flow conditioning apertures are positioned in the flow passage; and a connector for securing the plate carrier within the body such that the sealing surface seals against the body.

* * * * *